United States Patent [19]

D'Agnolo

[11] 4,432,198

[45] Feb. 21, 1984

[54] DEVICE FOR CONVEYING COPS

[75] Inventor: Armando D'Agnolo, Porcia, Italy

[73] Assignee: Officine Savio S.p.A., Italy

[21] Appl. No.: 358,618

[22] Filed: Mar. 16, 1982

[30] Foreign Application Priority Data

Mar. 25, 1981 [IT] Italy ..... 83350 A/81

[51] Int. Cl.[3] ..... D01H 9/18; D01H 9/02

[52] U.S. Cl. ..... 57/276; 57/266; 242/35.5 A; 242/35.5 R

[58] Field of Search ..... 57/266, 267, 271, 274, 57/275, 276; 242/35.5 R, 35.5 A

[56] References Cited

U.S. PATENT DOCUMENTS

| | | | |
|---|---|---|---|
| 3,154,904 | 11/1964 | Furst | 242/35.5 R X |
| 3,195,298 | 7/1965 | Reiners | 57/1 |
| 3,382,659 | 5/1968 | Schulz | 57/276 X |
| 3,398,519 | 8/1968 | Haussmann | 57/274 |
| 3,608,293 | 9/1971 | Brouwer | 242/35.5 R X |
| 3,788,054 | 1/1974 | Haussmann et al. | 57/266 X |

FOREIGN PATENT DOCUMENTS

| | | |
|---|---|---|
| 2236166 | 2/1973 | Fed. Rep. of Germany . |
| 1517543 | 3/1968 | France . |

*Primary Examiner*—Donald Watkins

*Attorney, Agent, or Firm*—Stevens, Davis, Miller & Mosher

[57] ABSTRACT

The invention relates to a device for conveying cops and winding tubes at one and the same time between a spinning frame and the relative winding heads which comprises a powered closed-ring conveyor means revolving in a substantially horizontal plane along each side of the spinning frame between one end of the spinning frame and the point of delivery of the cops to the winding heads pre-disposed downstream from the spinning frame, a plurality of pins carrying the cops or tubes and anchored to a conveyor, guides for the pins and a loading/unloading station where the tubes are loaded and the cops are doffed from the spindles of the spinning frame. The cops are conveyed on one side of the closed-ring conveyor, whereas the tubes to be fitted to the spindles of the spinning frame are conveyed advantageously on the other side of the conveyor.

16 Claims, 11 Drawing Figures

DEVICE FOR CONVEYING COPS

This invention relates to a device to convey winding tubes and cops at one and the same time for a spinning frame advantageously linked to a plurality of winding heads.

To be more precise, this invention relates to a close-dring type conveyor device able to transfer winding tubes and cops at the same time from a spinning frame directly, or through an intermediate station, to the turntable serving a plurality of winding heads.

Systems are known which combine a spinning frame together with a plurality of winding heads. Such known systems comprise various means and methods for conveying cops and tubes between the working units.

The system for conveying cops and tubes between spinning frame and winding machine as proposed in patent application IT 22362 A/78 (Japanese priority No. 43739 of 15.4.1977) in the name of Kuraray Co. Ltd. is known wherein one of two horizontal conveyor belts circulate near each side of the spinning frame and have on their movable surface some pins which convey the tubes and cops.

In that system, if there is only one conveyor belt, the belt discharges all the cops of a doffing at the station downstream and receives at the upstream end of the spinning frame the tubes for the next loading of the spinning frame.

The tubes are conveyed from the winding machine to the upstream end of the spinning frame by means of conveyors for tubes acting in the direction opposite to that of the forward movement of the conveyor belt.

If there are two conveyor belts positioned one on each side of the spinning frame, in such a system the tubes and cops are conveyed separately in the same direction towards the winding machine, while the means for conveying tubes to the upstream end of the spinning frame are still included.

This system has a limited output if there is only one single one-way conveyor belt bearing the doffed cops and the tubes to replace the same, and the system is expensive if it employs two separate conveyor belts moving in the same direction.

U.S. Pat. No. 3,154,904 comprises a spinning frame linked at its end to a winding machine. In the patent the doffed cops lie horizontally on a conveyor belt, which takes them to a second conveyor belt that turns them and delivers them to appropriate sloped cop containers pre-arranged in the turntable of the winding machine.

This patent does not visualize the re-delivery of tubes to the spinning frame nor the replacement of doffed cops with fresh tubes.

U.S. Pat. No. 3,132,463 comprises a spinning frame linked to a winding machine and an endless chain pre-arranged above the spinning frame and installed on a carriage which can be moved vertically or horizontally.

The continuous chain is provided with special grippers able to clamp the cops (or tubes) at their end from above and to lift them.

The system needs tubes of a particular kind and involves a drawback relative to the movements of the carriage bearing the endless chain since it requires towing means and accurate means to control the movements.

French Pat. No. 76.30435 also comprises a system for conveying suspended cops or tubes, whereby clamping means which are a part of the chain and cooperate with the neck of the tube on the endless chain, which itself too is suspended. The clamping means are complicated and expensive to make.

French Pat. No. 7320741 has a system for conveying bobbins by suspension on supports which can move on rail means hung over the working units.

This system is intended to convey bobbins between two groups of spinning machines working in two different production phases wherein the used bobbins are merely left in a discharge station.

German patent OS 2236166, includes a device for moving cops and tubes between a spinning frame and a winding machine, whereby the device has a plurality of conveyor belts pre-arranged around the spinning frame and forming two closed lanes, in each of which the tubes or cops are drawn along and then transferred to the winding machine.

While they are being thus conveyed, the cops and tubes lie stretched out lengthwise on the conveyor belts, and this is a fact which can spoil the cops and the yarn wound thereupon.

Luxembourg Pat. No. 39649 also discloses a spinning frame cooperating with a winding machine and the cops are conveyed with one single one-way conveyor belt which revolves in a closed ring around the spinning frame.

This system needs a relatively long belt and is therefore hardly economical besides being complex.

U.S. Pat. No. 3,195,298 discloses a device in which cops produced in a spinning machine are transported to a winding machine by an endless belt conveyor whereby the cops enter into vacant winding stations of the winding machine.

According to this patent the depleted cores doffed in the winding machine pass through intermediate devices to another endless belt conveyor which feeds the empty cores to the spinning machine.

This devices needs a lot of space and is fairly costly to build.

French Pat. No. 1.517.543 on the other hand discloses a device in which a winding machine is fed with cops which are transported from a spinning machine through two transport conveyors and onto an accumulation conveyor.

Also this device needs a considerable space and the need to pass the cops through three conveyors makes it rather complicated and slow.

Another drawback of this lay-out is that the cops and any tubes to replace them are all conveyed in one and the same lane.

One object of the present invention is to embody a system and the relative means to convey cops and tubes at the same time, whereby the system overcomes the aforesaid drawbacks relative to the known art.

Another object of this invention is to simplify the means conveying cops and tubes between a spinning frame and the winding heads pre-arranged downstream therefrom.

Yet another object of the invention is to provide a system conveying cops and tubes which enables the cops and tubes to be moved readily between the working units and enables the cops and tubes to be easily handled by conveying them on anchorage pins.

One advantage of the invention is that it enables any doffing system and any system to find the tail-end of the cops to be employed.

Another advantage of this invention is that it permits the cops and tubes to be conveyed along straight and curved paths.

Yet another advantage is an outstanding increase in the capacity for doffing the cops and transferring them from the spinning frame to the winding heads and the short conveying times.

This invention is embodied in a device for the simultaneous conveying of cops and tubes between a spinning frame and the relative winding heads, whereby the device consists of a powered conveyor means formed as a closed ring and rotating in a horizontal plane along each side of the spinning frame between one end of the spinning frame and the point which supplies the winding heads pre-arranged downstream from the spinning frame.

The invention also embodies a plurality of means anchored to the conveyor means and carrying the cops and tubes, and also guide means for the carrying means.

According to the invention, means for loading tubes are pre-disposed near the point of exit of the cops from the conveyor means.

According to the invention the cops doffed from the spinning frame are conveyed on one side of the closed-ring type conveyor means, whereas the tubes to be fitted onto the spindles of the spinning frame are conveyed on the other side of said conveyor means.

According to one lay-out of the invention the cops discharged are transferred directly from the conveyor means to the turntable feeding the winding heads.

When such is the case, the forward movement of the conveyor means is carried out step by step, depending on the summons coming from the turntable.

According to another lay-out of the invention the cops discharged are transferred indirectly to the turntable feeding the winding heads through an intermediate storage or reserve station positioned between the spinning frame and the winding heads.

In such a case the forward movement of the conveyor means can be continuous or discontinuous and be regulated in either case by suitable signals coming from the intermediate reserve station.

According to the invention again, the conveyor means can be embodied with any material or can consist of chains, metal cables or another material, suitable for the purpose, to which the means bearing the tubes or cops are anchored.

It should be emphasized that, when a chain or cable is used, the conveyor means according to the invention permit, whenever necessary, the tubes or cops conveyed to be sloped in respect of their vertical axis owing to the rail-wise or strip-wise guide means, which can be suitably shaped along their development.

This ability can possibly be used advantageously either for the discharging of the tubes and cops from the belt means or for loading empty tubes on the conveyor means.

Moreover, according to the invention it is possible to fit on each means bearing the cops a pincer means to grip the tail-end of the yarn.

It is also possible that the search for the end of the yarn is carried out on all the cops arriving at a station at the point where the cops leave the conveyor means.

Other details and features of the invention will stand out from the description given below by way of non-limitative example and with reference to the accompanying drawings, in which.

In the figures the same parts or parts having the same functions bear the same reference numbers.

Figure 1:
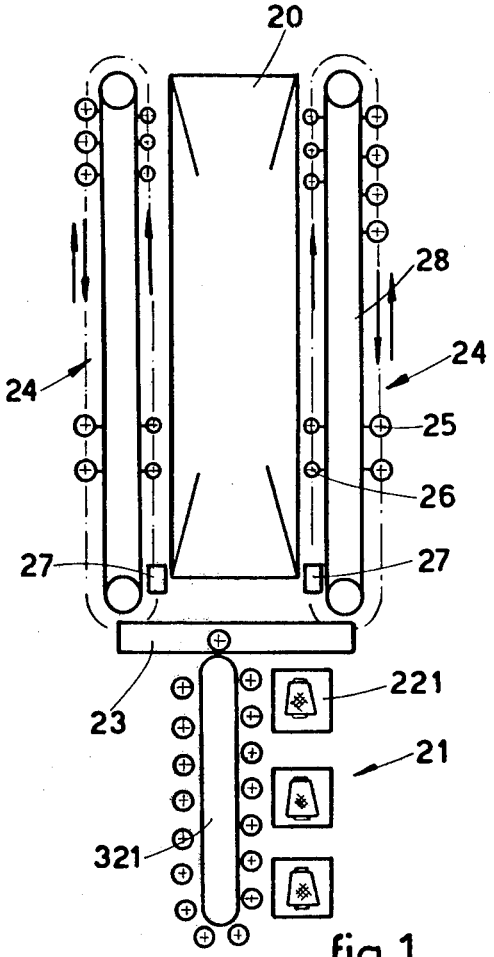
FIG. 1 shows a conveyor device according to the invention which delivers the cops to an intermediate storage station.

FIG. 1 shows a spinning frame 20 cooperating with a winding machine 21 which has a plurality of winding heads 221 and a feeder turntable 321.

Between the spinning frame 20 and winding machine 21 is an intermediate storage station 23 whereinto are deposited the cops coming from the spinning frame before they are transferred to the turntable 321 of the winding machine 21.

The device according to the invention bears the reference number 24 and comprises a pair of conveyor means 24 predisposed to correspond with each side of the spinning frame 20.

The conveyor means 24 rotate in a horizontal or almost horizontal plane and bear on their outer side the cops 25 doffed from the spinning frame up to the storage or reserve station 23.

At the same time as the cops 25 are being conveyed on one side, the tubes 26 are conveyed instead on the other side up to the spinning frame, having been taken from a station to load empty tubes 27 pre-disposed in the part downstream from the spinning frame 20.

The conveyor means 24 each consist of belt means, or chain means, or cable means, closed in a ring and rotating in a substantially horizontal or almost horizontal plane parallel to the side of the spinning frame.

In this embodiment the cops 25 deposited in the intermediate storage station 23 are moved with known means (and therefore not described here) to the turntable 321 of the winding machine 21.

The forward movement of the conveyor means 24 is governed by signals coming from the storage station 23, which regulate the action of motor means (not shown here) towing the conveyor means 24.

The forward movement can be step by step, continuous or discontinuous, depending on the nature and method of working of the storage station 23.

Figure 2:
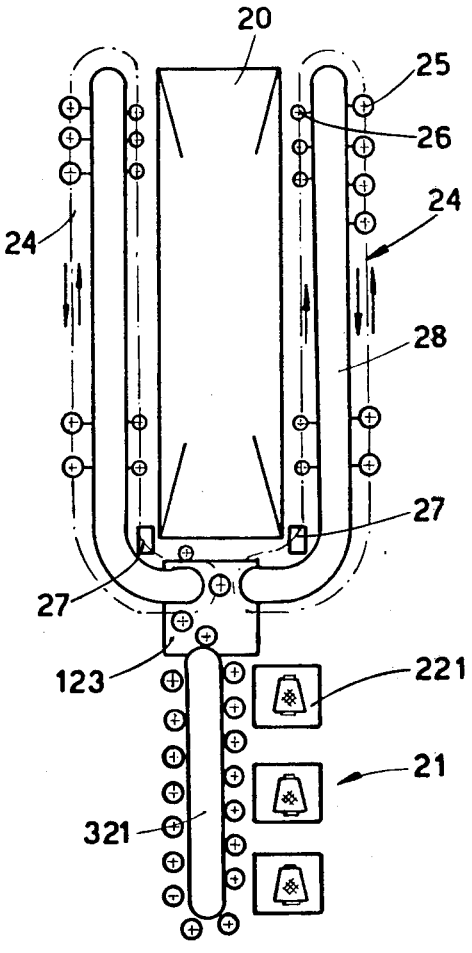
FIG. 2 shows the conveyor device which delivers the cops directly to the turntable feeding the winding heads.

FIG. 2 shows an embodiment which is substantially like the first embodiment described but wherein the cops 25, are transferred substantially directly from the conveyor means 24 to the turntable 321 of the winding machine 21.

The transfer takes place in a station 123 for direct transfer of the cops 25 from the conveyor means 24 to the turntable 321.

In this embodiment it is clear that the conveyor means 24 are able to carry the cops 25 and tubes 26 along a path which is both straight and curved, and this fact provides outstanding advantages.

The forward movement of the conveyor means 24 can ideally be step by step, and in such a case the movement is governed by appropriate signals coming from the turntable 321 and controlling the motor means of the conveyor means 24.

In the two lay-outs described the cops 25 are doffed from the spinning frame 20 and pre-disposed on suitable carrying means 31 arranged at the side of and on the conveyor means 24 and are conveyed to the turntable 321 of the winding machine 21 by the rotation of the conveyor means 24.

In the meanwhile the returning side of the conveyor means 24 is loaded with fresh tubes 26, which are arranged thereafter on the spindles of the spinning frame.

Figure 3:
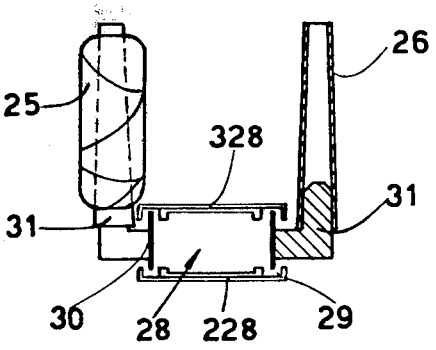
FIGS. 3 to 9 show variants of the conveyor means embodied with a closed-ring belt.

FIG. 3 shows a crosswise section of conveyor means 24 consisting of a fixed carrying structure 28 formed with a lower 228 and an upper 328 part.

Both the parts 228 and 328 are equipped with lengthwise guide grooves 29 that enable the belt 30 to follow a closed-ring path.

The guide grooves 29 lie substantially near to the edges of the carrying structure 28 and are able to guide a closed-ring type powered conveyor belt 30 in the cases of FIGS. 3 to 9 inclusive, the belt 30 being pre-disposed so as to run with its outer surface substantially upright.

The conveyor means 24, as shown in FIGS. 3–9, comprise means 31 carrying both cops 25 and tubes 26, the means 31 being fixed at the outside of and at the side of the belt means 30.

In the FIGS. the carrying means 31 consist substantially of an L-shaped pin fixed to the belt 30, while their upright part has a tapered shape advantageously and comprises a diameter that cooperates with the inner diameter of the tube 26 to be conveyed. This enables the tube to be lodged in a steadfast manner on the pin 31.

Figure 4:
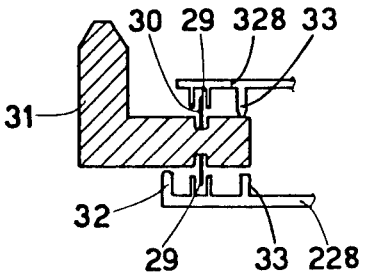
Figure 6:
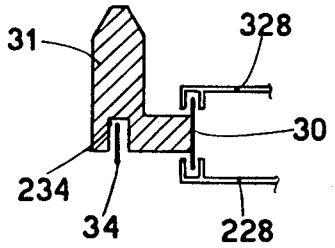
Figure 5:
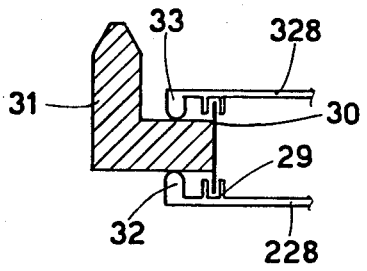
Figure 7:
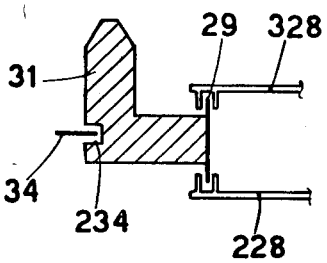
Figure 8:
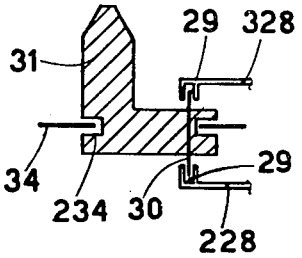

The embodiments shown in FIGS. 4 and 5 have additional guiding and supporting means 33–32, which are a part of the carrying structure 28 and are able to keep the pins 31 in a substantially upright position along the transfer path if the conveyor belt 30 is made of a not so stiff material which can be bent.

The embodiment of FIG. 4, for instance, comprises a jutting edge 32 provided on the inner part 228 of the carrying structure 28 outside the guiding groove 29, and an inner jutting edge 33 which can be arranged either on the lower or on the upper part of the carrying structure more towards the inside than the belt 30. This enables the horizontal part of the pin 31 to run supported in a substantially horizontal position.

In the embodiment of FIG. 5 the edges 32 and 33 are farther out than the belt 30 and as being located respectively on the lower and upper parts of the carrying structure 28.

The embodiments of FIGS. 6–7–8–9 are instead outer railwise guiding and supporting means 34 anchored, or not, to the carrying structure 28 and consisting of an upright or horizontal rail 34 cooperating with a corresponding groove 234 provided in the tube-bearing pin 31. The rails 34 lie parallel to the guiding grooves 29.

Figure 9:
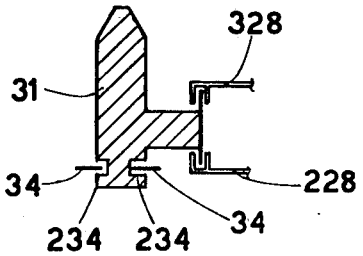

In the specific case of FIG. 9 the guiding and supporting rails 34 and corresponding grooves 234 are visualized as being respectively outside and inside the pin 31 so as to ensure a more efficient action.

Figure 10:
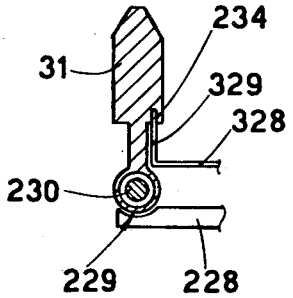
FIG. 10 shows a variant of the conveyor means embodied with a closed-ring cable.

In the embodiment of FIG. 10 the belt 30 is replaced with a cable 230 to which the tube-bearing pins 31 are anchored.

In this embodiment the lower part 228 of the carrying structure 28 comprises a shaped part which acts as a guide strip 229 on which the lower end of the tube-bearing pin 31 runs, while the upper part 328 of the carrying structure has an edge 329 protruding substantially vertically which acts as a rail and cooperates with a corresponding groove 234 located in the tube-bearing pin 31.

In all the embodiments it is possible to change the slope of the pin 31 and therefore of the axis of the cops 25 borne along the transfer path. This characteristic can be employed advantageously to facilitate either the removal of the cops 25 from the conveyor means 24 or the loading of the tubes 26 on the carrying means 31.

Figure 11:
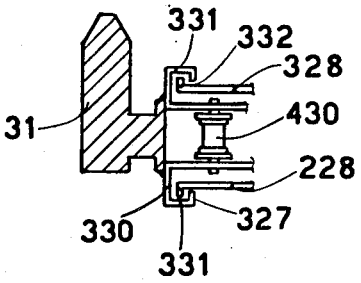
FIG. 11 shows a variant of the conveyor means embodied with a chain.

FIG. 11 shows yet another embodiment wherein the conveyor means consists of a chain 330 of links, for instance, or hooks, on which the anchorage pin means 31 are disposed. In this embodiment the links 330 have in their upper and lower edges guide means 331 able to cooperate with the edges 332 of the lower 228 and upper 328 parts of the carrying structure 28.

In FIG. 11 the means 31 bearing the tubes 26 and cops 25 are anchored to the chain 330, which cooperates with possible towing sprockets by means of the rollers 430.

Such cooperation serves as a guide for the conveyor means 330 and also as a support for the pin means 31.

It is evident that the conveyor means 30, 230 and 330 are provided with known towing means which are driven in such a way as to suit the needs of the other units in the group.

It is possible to change shapes, sizes and proportions and to add other variants or to replace the conveyor means 30, 230 and 330 with other suitable means. The type of supports for the pins 31 can be varied. It is possible to have means able to grip, hold and position the tail-end of the cop 25 and to cooperate with the carrying means 31, and so on.

The whole of the above is within the capacity of a technician in this field without going beyond the scope of this invention.

What is claimed is:

1. Device for conveying cops and tubes at the same time between a spinning frame and relative winding heads, comprising a closed-ring powered conveyor means revolving in a substantially horizontal plane along each side of the spinning frame between one end of said spinning frame and a point of delivery of the cops to the winding heads pre-arranged downstream from said spinning frame; a plurality of pins for bearing the cops or tubes anchored to said conveyor means; guide means for said pins, and a loading/unloading station where the tubes are loaded and said cops are doffed from spindles of the spinning frame, said cops being conveyed on a side of the closed-ring conveyor means away from said spinning frame while said tubes to be fitted to the spindles of said spinning frame are conveyed on the side of said conveyor means adjacent said spinning frame.

2. The device as in claim 1, wherein said station is pre-disposed upstream from the winding heads.

3. The device as in claim 1, including a turntable for feeding the winding head, said cops doffed from the spindles being delivered directly to the turntable feeding the winding heads.

4. The device as in claim 1, 2, or 3, wherein said conveyor means follow a straight path.

5. The device as in claim 1, 2, or 3, wherein said conveyor means follow a path which is at least partially curved.

6. The device as in claim 1, 2, or 3, wherein said conveyor means convey tubes and cops positioned alternately.

7. The device as in claim 1, 2, or 3, including a structure which bears said powered closed-ring conveyor means, said conveyor means revolving around the edges of said bearing structure and upholding the pins carrying the tubes and cops.

8. The device as in claim 1 wherein said conveyor means consist of a substantially flexible closed belt which upholds the pins carrying the tubes and cops.

9. The device as in claim 8, wherein said guide means define a structure which bears said powered closed-ring conveyor means and grooved means being arranged along the edges of the lower and upper parts of said bearing structure.

10. The device as in claim 9, wherein said a bearing structure has supporting and guiding means for the pins, said supporting and guiding means being pre-disposed outwards and/or inwards in respect of the closed belt and being anchored to both the lower and upper parts and along the groove means.

11. The device as in claim 9 or claim 10 including rail-wise guiding and supporting means stretching along the path of the conveyor means and consisting of one or more rails, one or more grooves cooperating with said rails, said grooves being provided on the pins so as to coincide with said guiding and supporting means.

12. The device as in claim 1, 2 or 3 including a structure having an upper part and a lower part, said lower part defining a strip machined therein, a rail carried by said upper part, each said pin defining a groove into which is located said rail, said closed-ring conveyor means consisting of a cable upholding the pins.

13. The device as in claim 1, 2 or 3 wherein said closed-ring conveyor means consist of a chain made of links and upholding the pins.

14. The device as in claim 13 wherein said chain comprises hook-wise ends cooperating with guides.

15. The device as in claim 1, wherein said pin is fixed to the outside of the conveyor means and has a substantially upright part with a tapered shape and with a maximum diameter slightly smaller than the inner diameter of the tube to be conveyed.

16. The device as in claim 1, wherein said pins comprise means to grip the tail-end of the cop.

* * * * *